US006383705B2

(12) United States Patent
Aoki et al.

(10) Patent No.: US 6,383,705 B2
(45) Date of Patent: May 7, 2002

(54) TONER FOR ELECTROPHOTOGRAPHY

(75) Inventors: Katsutoshi Aoki; Yoshihiro Fukushima; Yutaka Kanamaru; Koji Akiyama, all of Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/779,849

(22) Filed: Feb. 9, 2001

(30) Foreign Application Priority Data

Feb. 10, 2000 (JP) ..... 2000-033031

(51) Int. Cl.[7] ..... G03G 9/087

(52) U.S. Cl. ..... 430/109.4; 430/108.8; 430/111.4

(58) Field of Search ..... 430/109.4, 111.4, 430/109, 108.8

(56) References Cited

U.S. PATENT DOCUMENTS 5,057,392 A 10/1991 McCabe et al. ..... 430/109.4
5,147,747 A * 9/1992 Wilson et al. ..... 430/109.4

FOREIGN PATENT DOCUMENTS

JP 56-65146 * 6/1981 ..... 430/109.4

OTHER PUBLICATIONS

JPO Abstract of JP 05044032A, pub Feb. 23, 1993.*
Abstract 52666 D/29 describing JP 56–65146, pub Jun. 2, 1981 (attached to JP 56–65146).*
Derwent Abstract Acc No 1988–179035/198826 of JP 93–044032B, Jul. 5, 1993.
Derwent Abstract Acc No. 1981–52666D/198129 of JP 87–039428B, Aug. 22, 1987.
Derwent Abstract, AN 1988–031567, XP002167185 of JP 62–289850A, Dec. 16, 1987.
Derwent Abstract, AN 1988–040252, XP002167186 of JP 62–299859A, Dec. 26, 1987.

* cited by examiner

*Primary Examiner*—Janis L. Dote
(74) *Attorney, Agent, or Firm*—Birch, Stewart, Kolasch & Birch, LLP

(57) ABSTRACT

A toner for electrophotography comprising a resin binder comprising as its main components (a) a crystalline polyester having a softening point of from 85° to 150° C., obtainable by polycondensing an alcohol component which comprises 80% by mol or more of an aliphatic diol having 2 to 6 carbon atoms and a carboxylic acid component which comprises 80% by mol or more of fumaric acid; and (b) an amorphous polyester and/or an amorphous polyester-polyamide, obtainable by polycondensing monomers comprising 50% by weight or more of an aromatic compound, wherein a weight ratio of the crystalline polyester to the amorphous polyester and/or the amorphous polyester-polyamide, i.e. crystalline polyester/(amorphous polyester and/or amorphous polyester-polyamide), is from 1/99 to 50/50.

4 Claims, No Drawings

TONER FOR ELECTROPHOTOGRAPHY

BACKGROUND OF THE INVENTION

1. Field of the Invention

The present invention relates to a toner for electrophotography used for developing electrostatic latent images formed in electrophotography, electrostatic recording method, electrostatic printing, and the like.

2. Discussion of the Related Art

In the heat roller fixing method widely employed as a fixing method for a toner image, the method is excellent in that fixed images having excellent fastness can be obtained at a faster speed, as compared to other fixing methods, and that energy efficiency is high and little harm is caused to the environment by evaporation of a solvent or the like. However, there arises a defect that the offset phenomenon tends to be generated since the toner image is in direct contact with a fixing roller or belt.

On the other hand, from the viewpoint of energy-saving, there have been desired that a waiting time until which the temperature of the fixing device reaches an operable temperature is shortened, and that a toner is fixed at a lower temperature. Therefore, various methods have been tried, including a method of lowering a glass transition point of a resin binder or the like, a method of increasing low-molecular weight components, or a method using a plasticizer or the like. However, there arises a so-called "blocking," wherein the toner is aggregated and solidified during storage or in the developer device.

Therefore, as a method for lowering a fixing temperature, there has been known a toner comprising a crystalline polyester as a resin binder. For instance, Japanese Examined Patent Publication No. Sho 62-39428 discloses a toner comprising a resin binder comprising, a crystalline polyester made from an aromatic polycarboxylic acid component as an acid component, the aromatic polycarboxylic acid component being contained in an amount of 50% by mol or more, and an amorphous polyester made from an aromatic polycarboxylic acid component as an acid component, the aromatic polycarboxylic acid component being contained in an amount of 60% by mol or more. However, when the basic structure of the both polyesters is the same, these resins undesirably become compatible to each other when kneaded during the toner preparation, so that the glass transition point of the crystalline polyester cannot be maintained. In addition, Japanese Examined Patent Publication No. Hei 5-44032 discloses a toner comprising a crystalline polyester having a softening point of from 50° to 100° C., and a crystalline polyester having a high softening point. However, when the basic structure of the both polyesters is the same, the softening point of the polyester at a lower melting point side has mal-affects to pulverizability and storage stability for the same reasons as above.

An object of the present invention is to provide a toner for electrophotography which is excellent all of the low-temperature fixing ability, the offset resistance, the blocking resistance, and the pulverizability, and capable of maintaining a high level of triboelectric charges for a long period of time, without causing contamination of the photoconductor.

These and other objects of the present invention will be apparent from the following description.

SUMMARY OF THE INVENTION

According to the present invention, there is provided a toner for electrophotography comprising a resin binder comprising as its main components:

(a) a crystalline polyester having a softening point of from 85° to 150° C., obtainable by polycondensing an alcohol component which comprises 80% by mol or more of an aliphatic diol having 2 to 6 carbon atoms and a carboxylic acid component which comprises 80% by mol or more of fumaric acid; and (b) an amorphous polyester and/or an amorphous polyester-polyamide, obtainable by polycondensing monomers comprising 50% by weight or more of an aromatic compound, wherein a weight ratio of the crystalline polyester to the amorphous polyester and/or the amorphous polyester-polyamide, i.e. crystalline polyester/(amorphous polyester and/or amorphous polyester-polyamide), is from 1/99 to 50/50.

DETAILED DESCRIPTION OF THE INVENTION

The toner for electrophotography of the present invention comprises a resin binder comprising a crystalline polyester (Resin A) and an amorphous polyester and/or an amorphous polyester-polyamide (Resin B) as its main components. A total amount of the crystalline polyester and the amorphous polyester and/or the amorphous polyester-polyamide in the resin binder is preferably from 50 to 100% by weight, more preferably from 80 to 100% by weight, especially preferably 100% by weight.

The crystalline polyester used as Resin A is obtained by using monomers containing an alcohol component comprising a dihydric or higher polyhydric alcohol, and a carboxylic acid component comprising a dicarboxylic or higher polycarboxylic acid, an acid anhydride thereof, or an ester thereof. From the viewpoints of the softening point and the crystallinity of the resin, there can be used an aliphatic diol having 2 to 6 carbon atoms in an amount of 80% by mol or more, preferably from 90 to 100% by mol in the alcohol component, and fumaric acid in an amount of 80% by mol or more, preferably from 85 to 100% by mol in the carboxylic acid component. The aliphatic diol having 2 to 6 carbon atoms includes 1,4-butanediol, ethylene glycol, 1,2-propylene glycol, 1,3-propylene glycol, 1,6-hexanediol, neopentyl glycol, 1,4-butenediol, 1,5-pentanediol, and the like. Among them, α,ω-linear alkylene glycols are preferable, and 1,4-butanediol are more preferable.

The dihydric alcohol which may be used other than the aliphatic diol having 2 to 6 carbon atoms includes diethylene glycol, triethylene glycol, 1,8-octanediol, 1,4-cyclohexanedimethanol, dipropylene glycol, polyethylene glycol, polypropylene glycol, polytetramethylene glycol, hydrogenated bisphenol A, and the like. Among them, aliphatic diols having 7 to 20 carbon atoms, condensates thereof and condensates of the aliphatic diol having 2 to 6 carbon atoms are preferable.

The trihydric or higher polyhydric alcohol includes sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and the like. Among them, from the viewpoints of the softening point and the crystallinity of the resin, glycerol is preferable.

In addition, preferred dicarboxylic acids, acid anhydrides thereof, or esters thereof other than fumaric acid are maleic acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, or a substituted succinic acid of which substituent is an alkyl group having 1 to 20 carbon atoms or an alkenyl group having 2 to 20 carbon atoms, such as dodecenylsuccinic acid and octylsuccinic acid; and derivatives thereof such as acid anhydrides thereof and alkyl(1 to 3 carbon atoms) esters thereof.

The tricarboxylic or higher polycarboxylic acid, an acid anhydride thereof, or an ester thereof includes 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, Empol trimer acid, and derivatives thereof such as acid anhydrides thereof and alkyl(1 to 3 carbon atoms) esters thereof. Among them, from the viewpoints of the softening point and the crystallinity of the resin, trimellitic acid and derivatives thereof are preferable.

In the present invention, in order to form a non-linear polyester as the crystalline polyester, it is desired that trivalent or higher polyvalent monomers, which are selected from the group consisting of trihydric or higher polyhydric alcohols and tricarboxylic or higher polycarboxylic acids, acid anhydrides thereof, or esters thereof, are contained in an amount of from 0.1 to 30% by mol, preferably from 0.1 to 20% by mol, more preferably from 1 to 10% by mol, of all monomers used for polycondensation.

The polycondensation of the alcohol component and the carboxylic acid component can be carried out, for instance, by the reaction at a temperature of from 120° to 250° C., preferably 150° C. or more and preferably 210° C. or less, in an inert gas atmosphere, using an esterification catalyst and a polymerization inhibitor as occasion demands. Concretely, in order to enhance the strength of the resin, the entire monomers may be charged at once. Alternatively, in order to reduce the low-molecular weight components, divalent monomers are firstly reacted, and thereafter trivalent or higher polyvalent monomers are added and reacted.

In the present invention, the term "crystalline" means that the ratio of the softening point to the maximum peak temperature of heat of fusion as determined by DSC, i.e. softening point/peak temperature, is 0.9 or more and less than 1.1, preferably from 0.98 to 1.05, and the term "amorphous" means that the ratio of the softening point to the maximum peak temperature of heat of fusion as determined by DSC, i.e. softening point/peak temperature, is from 1.1 to 4.0, preferably from 1.5 to 3.0.

The crystalline polyester has a softening point of preferably from 85° to 150° C., more preferably from 100° to 140° C., and a maximum peak temperature of heat of fusion of preferably from 77° to 150° C., more preferably from 90° to 140° C.

The tetrahydrofuran-soluble component of the crystalline polyester has a number-average molecular weight of preferably from 500 to 6000, more preferably from 500 to 5000, from the viewpoints of the blocking resistance and the melt viscosity.

When the crystalline polyester resin comprises two or more resins, it is desired that at least one, preferably all, of the resins are crystalline polyesters described above.

As Resin B, the amorphous polyester and/or the amorphous polyester-polyamide is used. In the present invention, the amorphous polyester is preferable, from the viewpoint of the fixing ability.

The amorphous polyester used as Resin B is obtained by using monomers of known polyhydric alcohol components and polycarboxylic acid components such as carboxylic acids, carboxylic acid anhydrides, and esters thereof.

The polyhydric alcohol component includes alkylene(2 to 3 carbon atoms) oxide(average number of moles: 1 to 10) adduct of bisphenol A such as polyoxypropylene(2.2)-2,2-bis(4-hydroxyphenyl)propane and polyoxyethylene(2.2)-2,2-bis(4-hydroxyphenyl)propane; ethylene glycol, propylene glycol, neopentyl glycol, glycerol, pentaerythritol, trimethylolpropane, hydrogenated bisphenol A, sorbitol, and alkylene(2 to 3 carbon atoms) oxide(average number of moles: 1 to 10) adducts thereof. These polyhydric alcohol components can be used in admixture of two or more kinds.

In addition, the polycarboxylic acid component includes dicarboxylic acids such as phthalic acid, isophthalic acid, terephthalic acid, fumaric acid and maleic acid; a substituted succinic acid of which substituent is an alkyl group having 1 to 20 carbon atoms or an alkenyl group having 2 to 20 carbon atoms, such as dodecenylsuccinic acid and octylsuccinic acid; trimellitic acid, pyromellitic acid, and derivatives thereof such as acid anhydrides thereof and alkyl(1 to 8 carbon atoms) esters thereof. These polycarboxylic acid components can be used in admixture of two or more kinds.

In addition, in the preparation of the amorphous polyester-polyamide, in addition to the above polyhydric alcohol component and the polycarboxylic acid component, in order to form an amide component, there are further added polyamines such as ethylenediamine, pentamethylenediamine, hexamethylenediamine, diethylenetriamine, iminobispropylamine, phenylenediamine, xylylenediamine and triethylenetetramine; aminocarboxylic acids such as 6-aminocaproic acid and ϵ-caprolactam; amino alcohols such as propanolamine; and the like. Among them, hexamethylenediamine and ϵ-caprolactam are preferable.

The amorphous polyester and the amorphous polyester-polyamide can be prepared in the same manner as in the crystalline polyester.

In the present invention, as monomers for the amorphous polyester and the amorphous polyester-polyamide, monomers containing an aromatic compound in an amount of 50% by weight or more, preferably from 60 to 95% by weight, are used. By using these monomers, since the basic structure of the crystalline polyester of Resin A is different from that of the amorphous polyester and/or the amorphous polyester-polyamide of Resin B, the properties of the crystalline polyester of Resin A can be maintained, without making Resin A compatible with Resin B when kneaded during the toner preparation.

Preferable aromatic compounds as raw material monomers for the amorphous polyester and the amorphous polyester-polyamide include trimellitic acid and derivatives thereof; isophthalic acid, terephthalic acid and derivatives thereof; alkylene oxide adducts of bisphenol A; phenylenediamine and xylylenediamine; and the like.

It is preferable that each of the amorphous polyester and the amorphous polyester-polyamide has a softening point of from 70° to 180° C., a maximum peak temperature of heat of fusion of from 50° to 85° C., a glass transition point of 45° to 80° C., and a weight percentage of components insoluble to chloroform is from 0 to 50% by weight, respectively. When the amorphous polyester and/or the amorphous polyester-polyamide each comprises two or more resins, it is desired that at least one, preferably all, of the resins is the amorphous polyester and/or the amorphous polyester-polyamide having the properties described above. From the viewpoints of establishing both the fixing ability and the blocking resistance, it is more preferable to use a mixture of a resin having a softening point of from 95° to 180° C. and a glass transition point of 50° to 80° C. (Resin a), and a resin having a softening point of from 70° to 125° C. and a glass transition point of 45° to 60° C. (Resin b), and that its mixing weight ratio, i.e. Resin a/Resin b, is from 50/50 to 95/5. Here, the glass transition point is a property inherently owned by the amorphous resin and refers to the temperature of an intersection of the extension of the baseline of not more than the glass transition point and the tangential line showing the maximum inclination between the kickoff of the peak and the top of curves.

The weight ratio of the above crystalline polyester to the amorphous polyester and/or the amorphous polyester-polyamide, i.e. crystalline polyester/(amorphous polyester and/or amorphous polyester-polyamide), is 1/99 or more, from the viewpoint of the lowest fixing temperature, and the weight ratio is 50/50 or less, from the viewpoint of preventing hot offset. The weight ratio is preferably from 5/95 to 40/60, especially preferably from 10/90 to 30/70. Incidentally, the crystalline polyester, the amorphous polyester, and the amorphous polyester-polyamide may be each be an independent resin, or a mixture of two or more resins.

It is preferable that the toner for electrophotography of the present invention may further comprise at least one wax. The wax includes natural waxes such as carnauba wax and rice wax; synthetic waxes such as polypropylene wax, polyethylene wax and Fischer-Tropsch wax; petroleum waxes such as montan wax; alcohol waxes; ester waxes; and the like. These waxes can be used alone or in admixture of two or more kinds. Among them, carnauba wax, polypropylene wax and Fischer-Tropsch wax are preferable, from the viewpoint of the compatibility with the resin binder.

It is desired that the melting point of the wax is lower than the softening point of the crystalline polyester by 10° C. or more, preferably by 10° to 50° C., provided that when two or more crystalline polyesters are contained, the softening point to be compared is the softening point of the crystalline polyester having the lowest softening point. The content of the wax is preferably from 0.5 to 10 parts by weight, based on 100 parts by weight of the resin binder.

Further, the toner for electrophotography of the present invention can contain in appropriate amounts additives such as colorants, charge control agents, releasing agents, electric conductivity modifiers, extenders, reinforcing fillers such as fibrous substances, antioxidants, anti-aging agents, fluidity improvers, and cleanability improvers.

As the colorants, all of the dyes and pigments which are used as conventional colorants for toners can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants may be used alone or in admixture of two or more kinds. The content of the colorant is preferably from 1 to 10 parts by weight, based on 100 parts by weight of the resin binder.

The toner for electrophotography of the present invention is preferably a pulverized toner, which can be produced by a kneading-pulverization method, comprising, for instance, homogeneously mixing a resin binder, a colorant, and the like in a mixer such as a ball-mill, thereafter melt-kneading with a closed kneader or a single-screw or twin-screw extruder, cooling, pulverizing and classifying the product. Further, a fluidity improver and the like may be added to the surface of the toner as occasion demands. The weight-average particle size of the resulting toner is preferably from 3 to 15 $\mu$m.

The toner for electrophotography of the present invention can be used alone as a developer, in a case where the fine magnetic material powder is contained. Alternatively, in a case where the fine magnetic material powder is not contained, the toner may be used as a nonmagnetic one-component developer, or the toner can be mixed with a carrier and used as a two-component developer.

EXAMPLES

[Softening Point]

The softening point refers to a temperature corresponding to ½ of the height (h) of the S-shaped curve showing the relationship between the downward movement of a plunger (flow length) and temperature, namely, a temperature at which a half of the resin flows out, when measured by using a flow tester of the "koka" type ("CFT-500D," manufactured by Shimadzu Corporation) in which a 1 g sample is extruded through a nozzle having a dice pore size of 1 mm and a length of 1 mm, while heating the sample so as to raise the temperature at a rate of 6° C./min and applying a load of 1.96 MPa thereto with the plunger.

[Maximum Peak Temperature of Heat of Fusion and Glass Transition Point]

The maximum peak temperature of heat of fusion is determined with a sample using a differential scanning calorimeter ("DSC Model 210," manufactured by Seiko Instruments, Inc.), when the sample is treated by raising its temperature to 200° C., cooling the hot sample at a cooling rate of 10° C./min. to 0° C., and thereafter heating the sample so as to raise the temperature at a rate of 10° C./min. The glass transition point refers to the temperature of an intersection of the extension of the baseline of not more than the glass transition point and the tangential line showing the maximum inclination between the kickoff of the peak and the top of curves.

[Number-Average Molecular Weight of Tetrahydrofuran-Soluble Component]

The number-average molecular weight is determined by using gel permeation chromatography (sample concentration: 0.5% by weight; eluent: tetrahydrofuran; flow rate: 1 ml/min.; temperature: 40° C.; column: GMHLX/G3000HXL (manufactured by Tosoh Corporation); standard sample: monodisperse polystyrene). Here, a sample which is prepared by placing 40 mg of resin powder and 10 ml of tetrahydrofuran in a 20-ml sample tube, stirring the mixture with a ball-mill at room temperature for 3 hours, and thereafter filtering the resulting mixture with a membrane filter (manufactured by Toyo Roshi K.K., 0.2 $\mu$m pore diameter) is used.

[Weight Percentage of Components Insoluble to Chloroform]

A 100 cc-glass bottle equipped with a screw cap is charged with 5 g of a resin powder, 5 g of "RADIOLITE #700" (manufactured by Showa Kagaku Kogyo K.K.) and 100 ml of chloroform, and the ingredients are stirred in a ball-mill at 25° C. for 5 hours, to give a resin liquid mixture. Thereafter, the resin liquid mixture is subjected to pressure filtration with a filter paper (No. 2 Paper, manufactured by Toyo Roshi Kaisha, Ltd.) which is evenly packed with 5 g of RADIOLITE. Subsequently, the solids on the filter paper are washed twice with 100 ml of chloroform, and then the solids are subjected to drying. Further, a weight percentage of components insoluble to chloroform is calculated according to the following equation:

$$\text{Weight Percentage of Insoluble Components (\% by weight)} = \frac{\text{Weight (g) of Solids on Filter Paper} - \text{Weight of } \textit{RADIOLITE} \text{ (10 g)}}{5\text{ g}} \times 100$$

[Melting Point of Wax]

The melting point refers to a temperature of top of endothermic peak obtained when measuring with a sample using a differential scanning calorimeter ("DSC Model 210," manufactured by Seiko Instruments, Inc.), when the sample is heated at a rate of 10° C./min.

Resin Preparation Example 1

A 5-liter four-necked flask equipped with a nitrogen inlet tube, a dehydration tube, a stirrer, and a thermocouple was charged with raw materials shown in Table 1, and the ingredients were reacted at 160° C. for 5 hours. Thereafter, the temperature was raised to 200° C. and reacted for 1 hour, and further reacted at 8.3 kPa for 1 hour. The softening point, the maximum peak temperature of heat of fusion, and the number-average molecular weight of tetrahydrofuran-soluble component of each of the resulting resins A to K (crystalline polyesters) are shown in Table 1.

TABLE 1

| | Resin A | Resin B | Resin C | Resin D | Resin E | Resin F | Resin G | Resin H | Resin I | Resin J | Resin K |
|---|---|---|---|---|---|---|---|---|---|---|---|
| Ethylene Glycol | | | | 124<br>10 | | | | | 161<br>13 | | |
| 1,4-Butanediol | 2070<br>100 | | 1800<br>100 | 1620<br>90 | 1800<br>100 | 1924<br>95.2 | 1924<br>95 | 1701<br>90 | | 1530<br>85 | |
| 1,6-Hexanediol | | 2362<br>100 | | | | | 133<br>5 | | 2055<br>87 | | 2362<br>100 |
| 1,8-Octanediol | | | | | | | | | | 438<br>15 | |
| Hydrogenated Bisphenol A | | | | | | | | 504<br>10 | | | |
| Glycerol | | | | | | 92<br>4.8 | | | | | |
| Fumaric Acid | 2535<br>93.5 | 2204<br>100 | 1972<br>81 | 2204<br>93.5 | 2088<br>88.6 | 2688<br>100 | 2480<br>93.5 | 2509<br>100 | 2320<br>100 | 2320<br>97.8 | |
| Succinic Acid | | | | | 118<br>4.9 | | | | | | 2360<br>100 |
| Trimellitic Anhydride | 291<br>6.5 | | 768<br>19 | 253<br>6.5 | 254<br>6.5 | | 285<br>6.5 | | | 127<br>2.2 | |
| Hydroquinone | 4.9 g | 4.6 g | 4.5 g | 4.2 g | 4.3 g | 4.7 g | 4.8 g | 4.7 g | 4.5 g | 4.4 g | 4.7 g |
| Softening Point (° C.) | 127.3 | 94.9 | 104.0 | 114.3 | 115.7 | 128.8 | 130.8 | 123.4 | 106.8 | 122.3 | 72.4 |
| Maximum Peak Temperature of Heat of Fusion (° C.) | 123.0 | 91.7 | 99.9 | 110.8 | 115.8 | 125.8 | 125.2 | 122.1 | 103.2 | 120.5 | 68.3 |
| Number-Average Molecular Weight of Tetrahydrofuran-Soluble Component | 705 | 1230 | 635 | 951 | 676 | 599 | 765 | 880 | 986 | 667 | 4120 |

Note: Unless specified otherwise, the amount on the upper level is expressed in g, and the amount on the lower level is expressed in % by mol in the acid or alcohol component.

Resin Preparation Example 2

A 5-liter four-necked flask equipped with a dehydration tube, a stirrer, and a thermocouple was charged with raw materials shown in Table 2 and 4 g of dibutyltin oxide, and the ingredients were reacted at 220° C. for 8 hours, and thereafter further reacted at 8.3 kPa until a given softening point was reached. The softening point, the maximum peak temperature of heat of fusion, the glass transition point, the content of the aromatic compound in the raw materials and the weight percentage of components insoluble to chloroform of each of the resulting resins a to k (amorphous polyesters) are shown in Table 2.

TABLE 2

| | Resin a | Resin b | Resin c | Resin d | Resin e | Resin f | Resin g | Resin h | Resin i | Resin j | Resin k |
|---|---|---|---|---|---|---|---|---|---|---|---|
| BPA-PO[1)] | 2000<br>47.1 | 1400<br>36.8 | | 2000<br>46.0 | 2800<br>72.7 | 1400<br>36.8 | 2000<br>59.7 | 1600<br>36.8 | 2000<br>48.3 | 2000<br>46.0 | |

TABLE 2-continued

| | Resin a | Resin b | Resin c | Resin d | Resin e | Resin f | Resin g | Resin h | Resin i | Resin j | Resin k |
|---|---|---|---|---|---|---|---|---|---|---|---|
| BPA-EO[2)] | 800<br>18.8 | 1300<br>34.2 | | 800<br>18.4 | | 1300<br>34.2 | 400<br>11.9 | 1450<br>33.3 | 800<br>18.4 | 800<br>19.3 | |
| Ethylene Glycol | | | 250<br>6.0 | | | | | | | | 400<br>10.3 |
| Neopentyl Glycol | | | 1200<br>28.6 | | | | | | | | |
| Hydrogenated Bisphenol A | | | | | | | | | | | 1400<br>35.9 |
| Terephthalic Acid | 600<br>14.1 | | 2000<br>47.6 | 400<br>9.2 | 400<br>10.4 | | 400<br>11.9 | 500<br>11.5 | 880<br>21.3 | 400<br>9.2 | 800<br>20.5 |
| Dodecenylsuccinic Acid Anhydride | 500<br>11.8 | | | | | | 300<br>9.0 | | 100<br>2.4 | | |
| Fumaric Acid | | 700<br>18.4 | | 600<br>13.8 | 650<br>16.9 | 700<br>18.4 | | | | 600<br>13.8 | 900<br>23.1 |
| Trimellitic Anhydride | 350<br>8.2 | 400<br>10.5 | 750<br>17.9 | 550<br>12.6 | | 400<br>10.5 | 250<br>7.5 | 800<br>18.4 | 360<br>8.7 | 550<br>12.6 | 400<br>10.3 |
| Softening Point (° C.) | 150 | 145 | 140 | 100 | 92.3 | 150 | 150 | 120 | 140 | 100 | 130 |
| Maximum Peak Temperature of Heat of Fusion (° C.) | 66.0 | 64.3 | 70.6 | 62.1 | 54.5 | 65.0 | 65.0 | 66.5 | 70.1 | 62.4 | 65.9 |
| Glass Transition Point (° C.) | 62.3 | 60.6 | 67.1 | 58.5 | 50.5 | 60.6 | 61.0 | 63.0 | 67.0 | 58.5 | 62.1 |
| Content of Aromatic Compounds (% by weight) | 88.2 | 81.5 | 65.5 | 86.2 | 83.1 | 81.5 | 91.0 | 100.0 | 96.7 | 87.1 | 30.8 |
| Weight Percentage of Chloroform-Insoluble Component (% by weight) | 34 | 28 | 12 | 0 | 0 | 26 | 33 | 1 | 7 | 0 | 0 |

Notes from Table 2:

1) Propylene oxide adduct of bisphenol A (average number of moles: 2.2 moles)

2) Ethylene oxide adduct of bisphenol A (average number of moles: 2.2 moles)

Note) Unless specified otherwise, the amount on the upper level is expressed in g, and the amount on the lower level is expressed in weight ratio.

Examples 1 to 15 and Comparative Examples 1 to 4

Resin binders with combinations and amounts shown in Table 3, a total amount of the binder resins being 100 parts by weight, 5 parts by weight of a carbon black "MOGUL L" (manufactured by Cabot Corporation), 2 parts by weight of polypropylene wax "BISCOL 550P" (manufactured by Sanyo Chemical Industries, Ltd.; melting point 120° C.), and 1 part by weight of a charge control agent "T-77" (manufactured by Hodogaya Chemical Co., Ltd.) were mixed with a Henschel mixer, and thereafter the resulting mixture was melt-kneaded with a twin-screw extruder. The resulting molten kneaded mixture was subjected to pulverization and classification using a high-speed jet mill pulverizer-classifier Model "IDS-2" (manufactured by Nippon Pneumatic MFG, Co., Ltd.), to give a powder having a weight-average particle size of 8 μm. The pulverizability at this stage was evaluated in accordance with the following evaluation criteria. The results are shown in Table 4.

[Evaluation Criteria of Pulverizability]

O: powder having a weight-average particle size of 8 μm is obtained without any problems.

x: melting is caused in the course of pulverization, so that continuous pulverization cannot be carried out.

To 100 parts by weight of the resulting powder was added 0.5 parts by weight of a hydrophobic silica "R-972" (manufactured by Nippon Aerosil), and mixed with a Henschel mixer, to give a toner.

Examples 16 to 18

The pulverizability was evaluated in the same manner as in Example 1, except for preparing a toner using resin binders with combinations and amounts shown in Table 3, a total amount of the binder resins being 100 parts by weight, to give a toner, and using carnauba wax "Camauba Wax" (imported by K.K. Kato Yoko, melting point: 83.6° C.) in Examples 16 and 17, or Fischer-Tropsch wax "Sazole Wax SP-105" (manufactured by Sazole, melting point: 105° C.) in Example 18 in place of the polypropylene wax, the wax being used in an amount of 2 parts by weight.

TABLE 3

| | Resins and Amounts Used (Parts by Weight) | | |
|---|---|---|---|
| Example 1 | Resin A/10 | Resin a/60 | Resin d/30 |
| Example 2 | Resin B/20 | Resin a/60 | Resin e/20 |
| Example 3 | Resin C/20 | Resin b/60 | Resin d/20 |
| Example 4 | Resin D/30 | Resin a/50 | Resin e/20 |
| Example 5 | Resin E/40 | Resin c/40 | Resin d/20 |
| Example 6 | Resin F/30 | Resin a/50 | Resin e/20 |
| Example 7 | Resin G/15 | Resin a/50 | Resin e/35 |
| Example 8 | Resin H/20 | Resin a/60 | Resin d/20 |
| Example 9 | Resin I/25 | Resin a/50 | Resin d/25 |
| Example 10 | Resin J/20 | Resin a/60 | Resin d/20 |
| Example 11 | Resin E/15 Resin F/15 | Resin a/50 | Resin d/20 |
| Example 12 | Resin A/15 | Resin b/55 | Resin c/15 Resin d/15 |
| Example 13 | Resin A/10 | | Resin f/90 |
| Example 14 | Resin I/10 | | Resin f/90 |
| Example 15 | Resin I/10 | | Resin g/90 |
| Example 16 | Resin I/10 | | Resin f/90 |
| Example 17 | Resin I/10 | Resin f/70 | Resin j/20 |
| Example 18 | Resin I/10 | Resin f/70 | Resin j/20 |
| Comparative Example 1 | Resin A/70 | | Resin a/30 |
| Comparative Example 2 | Resin E/40 | | Resin k/60 |
| Comparative Example 3 | Resin K/10 | | Resin g/90 |
| Comparative Example 4 | — | Resin a/60 | Resin d/40 |

Test Example 1

To 4 parts by weight of each toner was added and mixed 96 parts by weight of silicon-coated ferrite carrier having an average particle size of 90 μm (manufactured by Kanto Denka Kogyo Co., Ltd.), to give a developer. Next, the resulting developer was loaded in a modified apparatus of a copy machine "AR-505" (manufactured by Sharp Corporation) at a printing rate of 50 sheets/minute. By sequentially increasing the fixing roller temperature from 90° to 240° C., the formed images were developed to determine the lowest fixing temperature and the hot offset generating temperature by the following methods. The results are shown in Table 4.

(1) Lowest Fixing Temperature

The lowest fixing temperature used herein referred to the temperature of the fixing roller at which the fixing ratio of the toner exceeded 70%. This fixing ratio of the toner was determined by placing a load of 500 g on a sand-rubber eraser (LION No. 502) having a bottom area of 15 mm×7.5 mm on a fixed toner image obtained in the fixing device, moving the loaded eraser on the image backward and forward five times, measuring the optical reflective density of the image before or after the eraser treatment with a reflective densitometer "RD-915" manufactured by Macbeth Process Measurements Co., and then calculating the fixing ratio by the following equation.

$$\text{Fixing Ratio} = \frac{\text{Opitcal Density After Eraser Treatment}}{\text{Optical Density Before Eraser Treatment}} \times 100$$

(2) Hot-Offset Generating Temperature

Fixed images were developed at each temperature, and subsequently blank image-transfer paper was conveyed through the fixing roller under the same conditions as above. The "hot offset generating temperature" is referred to a temperature of the fixing roller at which toner dusts were initially generated on the blank paper.

Test Example 2

A 100-ml glass bottle was charged with 10 g of each toner, and allowed to stand under the following conditions for 24 hours. The blocking resistance was evaluated in accordance with the following evaluation criteria. The results are shown in Table 4.

Conditions A: temperature: 50° C., relative humidity: 50%

Conditions B: temperature: 50° C., relative humidity: 90%

[Evaluation Criteria]

O: completely no blocking being observed under both Conditions A and B;

Δ: blocking being observed only under Conditions B;

x: blocking being observed under both conditions A and B.

Test Example 3

To 4 parts by weight of each toner was added and mixed 96 parts by weight of silicon-coated ferrite carrier having an average particle size of 90 μm (manufactured by Kanto Denka Kogyo Co., Ltd.), to give a developer. Next, the resulting developer was loaded in a modified apparatus of a copy machine "AR-505" (manufactured by Sharp Corporation) at a printing rate of 50 sheets/minute, and 210 mm×297 mm (A4 size) original sheet having a blackened proportion of 5% was subjected to 300000-sheets continuous printing. During the continuous printing, a small amount of toner was sampled after printing 1000 sheets (printing at start) and at the termination of the continuous printing (after durable printing). The triboelectric charges of the toner was determined by "q/m meter" (manufactured by Epping), and at the same time the contamination of the photoconductor after the termination of the continuous printing was visually examined. The results are shown in Table 4.

TABLE 4

| Ex. No. | Pulverizability | Lowest Fixing Temp. (° C.) | Hot Offset Generating Temp. (° C.) | Blocking Resistance | Triboelectric Charge (μC/g) Printing at Start | Triboelectric Charge (μC/g) After Durable Printing | Contamination of Photoconductor |
|---|---|---|---|---|---|---|---|
| 1 | ○ | 160 | 240< | ○ | −22.3 | −19.8 | None |
| 2 | ○ | 140 | 240< | Δ | −23.5 | −20.1 | None |
| 3 | ○ | 130 | 240< | ○ | −23.1 | −20.5 | None |
| 4 | ○ | 130 | 240< | ○ | −23.0 | −20.5 | None |
| 5 | ○ | 120 | 240< | ○ | −22.5 | −19.5 | None |
| 6 | ○ | 130 | 240< | ○ | −22.6 | −19.5 | None |
| 7 | ○ | 140 | 240< | ○ | −23.1 | −19.9 | None |
| 8 | ○ | 150 | 240< | Δ | −23.3 | −20.4 | None |
| 9 | ○ | 140 | 240< | ○ | −22.9 | −20.3 | None |
| 10 | ○ | 160 | 240< | ○ | −21.9 | −19.5 | None |
| 11 | ○ | 150 | 240< | ○ | −22.0 | −19.4 | None |
| 12 | ○ | 160 | 240< | ○ | −23.3 | −20.2 | None |
| 13 | ○ | 160 | 240< | ○ | −22.5 | −19.4 | None |
| 14 | ○ | 160 | 240< | ○ | −23.3 | −19.9 | None |
| 15 | ○ | 160 | 240< | ○ | −23.4 | −20.1 | None |
| 16 | ○ | 140 | 240< | ○ | −22.0 | −19.8 | None |
| 17 | ○ | 120 | 240< | ○ | −22.2 | −20.0 | None |
| 18 | ○ | 120 | 240< | ○ | −23.5 | −20.4 | None |
| Comp. Ex. No. | | | | | | | |
| 1 | x | 140 | 160 | ○ | −16.5 | −14.0 | None |
| 2 | ○ | 140 | 180 | x | −18.5 | −11.1 | Filming is generated |
| 3 | x | 130 | 190 | x | −17.2 | −9.3 | None |
| 4 | ○ | 190 | 240< | ○ | −23.3 | −20.1 | None |

Note

"240<" means that no offset is generated at 240° C.

It is clear from the above results that all of the toners of Examples 1 to 18 are low in the lowest fixing temperature, and excellent in both the offset resistance and the blocking resistance, so that excellent triboelectric chargeability can be maintained even after durable printing, without causing contamination of the photoconductor. On the other hand, in the case of the toner of Comparative Example 1 where the crystalline polyester is contained in a large amount, the pulverizability is poor, the viscosity during melt-kneading is low, and the dispersion of the charge control agent becomes poor, so that sufficient triboelectric charges cannot be obtained. In the case of the toner of Comparative Example 2 where the amorphous polyester having a low content of the aromatic compound in the monomers used is contained, since the compatibility of the resins themselves are high, a part of the crystalline polyester undesirably becomes amorphous, so that the resulting toner is poor in the blocking resistance, whereby filming on the photoconductor is generated. Also, in the case of the toner of Comparative Example 3 where the crystalline polyester has a low softening point, the blocking resistance and the pulverizability are poor even though contamination of the carrier is not observed, and the lowering of the triboelectric charges after durable printing is remarkable. In the case of the toner of Comparative Example 4 containing two kinds of amorphous polyesters are contained, without containing a crystalline polyester, the low-temperature fixing ability is poor.

According to the present invention, there can be obtained a toner for electrophotography which is excellent in the low-temperature fixing ability, the offset resistance, the blocking resistance, and the pulverizability, and capable of maintaining a high level of triboelectric charges for a long period of time, without causing the contamination of the photoconductor.

What is claimed is:

1. A toner for electrophotography comprising a resin binder comprising as its main components:

(a) a crystalline polyester having a softening point of from 85° to 150°C., obtained by polycondensing an alcohol component which comprises 80% by mol or more of an aliphatic diol having 2 to 6 carbon atoms and a carboxylic acid component which comprises 80% by mol or more of fumaric acid; and (b) an amorphous polyester and/or an amorphous polyester-polyamide, obtained by polycondensing monomers comprising 50% by weight or more of an aromatic compound, wherein a weight ratio of the crystalline polyester to the amorphous polyester and/or the amorphous polyester-polyamide, i.e., crystalline polyester/(amorphous polyester and/or amorphous polyester-polyamide), is from 1/99 to 50/50.

2. The toner according to claim 1, wherein the crystalline polyester is obtained by polycondensing monomers comprising 0.1 to 30% by mol of trivalent or higher monomers selected from the group consisting of trihydric or higher polyhydric alcohols and tricarboxylic or higher polycarboxylic acids, acid anhydrides thereof, or esters thereof.

3. The toner according to claim 1, wherein the amorphous polyester has a softening point of from 70° to 180° C., and a glass transition point of from 45° to 80° C.

4. The toner according to claim 1, further comprising at least one wax of which melting point is lower than the softening point of the crystalline polyester by 10° C. or more.

* * * * *